US006352969B2

(12) United States Patent
Hsu et al.

(10) Patent No.: US 6,352,969 B2
(45) Date of Patent: Mar. 5, 2002

(54) METHOD FOR APPLYING FRAGRANCE TO A DRYER SHEET

(75) Inventors: Feng-Lung Gordon Hsu, Tenafly, NJ (US); Kevin Schnaudigel, Brewster, NY (US); Françoise Fredericks, Hackensack, NJ (US); Daniel Joseph Fox, Tenafly, NJ (US); Robert Ahart, Mahwah, NJ (US); John Lovas, Kearny, NJ (US); David Van Blarcom, West Milford, NJ (US); Kristina Marie Neuser, Cliffside Park, NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/850,989

(22) Filed: May 8, 2001

Related U.S. Application Data

(63) Continuation of application No. 09/504,098, filed on Feb. 15, 2000.

(60) Provisional application No. 60/130,773, filed on Apr. 23, 1999.

(51) Int. Cl.[7] ..... C11D 3/50

(52) U.S. Cl. ..... 510/520

(58) Field of Search ..... 510/520

(56) References Cited

U.S. PATENT DOCUMENTS

| | | | | | |
|---|---|---|---|---|---|
| 3,632,396 | A | * | 1/1972 | Perez-Zamora | 117/76 P |
| 4,073,996 | A | * | 2/1978 | Bedenk et al. | 428/274 |
| 4,118,525 | A | * | 10/1978 | Jones | 427/242 |
| 4,242,377 | A | * | 12/1980 | Roberts et al. | 427/242 |
| 4,619,779 | A | * | 10/1986 | Hardy | 252/91 |
| 4,752,422 | A | * | 6/1988 | Uchida et al. | 261/81 |
| 5,234,610 | A | * | 8/1993 | Gardlik et al. | 252/8.6 |
| 5,246,603 | A | * | 9/1993 | Tsaur et al. | 252/86 |
| 5,425,887 | A | * | 6/1995 | Lam et al. | 252/8.6 |
| 5,500,137 | A | * | 3/1996 | Bacon et al. | 252/8.6 |
| 5,656,584 | A | * | 8/1997 | Angell et al. | 510/441 |

* cited by examiner

*Primary Examiner*—John Hardee
(74) *Attorney, Agent, or Firm*—Edward A. Squillante, Jr.

(57) ABSTRACT

A process for applying relatively volatile or heat sensitive ingredients, such as perfume, to fabric dryer sheets minimizes the loss of the ingredients to the atmosphere or through degradation.

7 Claims, 7 Drawing Sheets

METHOD FOR APPLYING FRAGRANCE TO A DRYER SHEET

PRIORITY

This is a continuation of Ser. No. 09/504,098 filed Feb. 15, 2000, allowed.

This application claims priority to provisional application Ser. No. 60/130,773 filed Apr. 23, 1999.

BACKGROUND

A well known commercial product in the laundry care industry is the fabric dryer sheet. In use, the consumer typically uses at least one sheet in the drying cycle of the laundering process. The sheets generally include a substrate material, such as a web, wherein the substrate carries one or more ingredients to impart desired benefits to the clothing. These ingredients can include, for example, perfumes, anti-static agents, dye transfer inhibitors, whitening agents, enzymes, stain repellents and wrinkle reducing agents.

Processes for fabricating these dryer sheets are also well known. In a typical process, a large role of the web material is guided at high speeds through various coating, smoothing and drying/cooling steps wherein one or more ingredients are applied to the web. An example of this process is shown in FIG. 1.

With reference to FIG. 1, web 5 is preferably a polyester material and provided in rolls 2. Rolls 2 are typically about 37 inches to about 85 inches in width and have a length between about 8,000 and about 13,000 yards. Web 5 passes through various rollers and rods wherein ingredients are applied to the web. As shown, web 5 is passed over guide roll 12 and onto applicator roll 14. Applicator roll 14 transfers ingredients 17 from coating pan 15 onto the web. A holding tank (not shown) can be used to supply the ingredients to coating pan 15. Preferably, automatic controls are used to ensure a proper level and temperature of ingredients 17 in pan 15.

As known in the art, ingredients 17 can include perfume material in addition to other fabric treatment agents, particularly those that provide anti-static and fabric softening benefits. These fabric treatment agents can include, for example: cationic compounds, such as quartery ammonium compounds; nonionic surfactants, such as ethoxylated alcohols; fatty alcohols; fatty acids; alkali metal soaps of fatty acids; carboxylic acids and salts thereof; fatty acid esters; glycerides; waxes; anionic surfactants; water; optical brighteners; fluorescent agents; antioxidants; colorants; germacides; perfumes; bacteriocides; enzymes; dye transfer inhibitors; soil release polymers; skin care benefit agents; perfume carriers (e.g. starch, clyclodextrins); wrinkle reducing agents; and the like. Various preferred non-cationic formulations are disclosed in U.S. patent applications Ser. No. 08/832,887, filed Apr. 4, 1997, the contents of which is incorporated by reference. In prior art processes, perfume has been present from about 2 wt % to about 6 wt % based on total ingredients 17.

In a preferred embodiment, the ingredients are maintained at approximately 140–190° F. in both the holding tank and coating pan 15. At this temperature, one or more ingredients can be lost to the atmosphere due to their volatility or be adversely affected by means of thermal degradation. When the perfume is present, it is estimated that there is a loss of approximately 15 wt. % of the perfume to the atmosphere at this coating step.

Further on in the process of FIG. 1, after coated in the coating pan, coated web 5' passes over smoothing rod 18 to guide roll 20. From guide roll 20, the web passes to heating drum 22, travels to cooling drums 24 and 26, which are preferably cooled to below about 100° F. by chilled water. Cooled web 5' then passes to trimming station 28, wherein the web is rolled and preferably cut into roles 2'. Roles 2' are preferably about 12 inches in width. At this point in the process, the roles can be stored for later cutting and packaging. During the process shown in FIG. 1, the web can travel as fast as 1,000 feet per minute. It is estimated that the additional perfume lost after the step of coating can be in the range of approximately 20 wt. % to 30 wt. % from that which was originally present in pan 15.

Turning to FIG. 2, final processing of coated web 5' is carried out by passing one or more of the coated roles 2' through a series of guide rollers 32. The web is then folded by folders 34, passed to conveyor 36 and cut by knife 38. After cutting, the folded sheets are tamped down, stacked and accumulated for packaging.

During the above-described processes, it has been found that a significant amount of volatile agents can be lost prior to final packaging, particularly perfumes. This is generally due to the relatively high volatility of most perfume agents. For example, it has been found that up to 45% of the perfume added in a typical process can be lost by the time the dryer sheet is folded and packaged.

Therefore, there is a need for an improved fabric dryer sheet manufacturing process wherein the loss of volatile agents during the process of making the fabric sheets is minimized.

Perfume agents can be classified by their relative volatility. High volatile perfumes are known as "high notes" while relatively unvolatile perfumes are known as "low notes". Due to their high volatility, high note perfumes are typically more perceptible by humans than low note perfumes. High note perfumes also have a wider range of odors and, therefore, allow for greater flexibility when selecting perfume agents. Unfortunately, when manufacturing dryer sheets, it is the desired high notes that can be lost during processing. This has resulted in a decreased amount of high note perfumes making it into the packaged product and alteration of the perfume profile. Use of high note perfumes have also been reduced or eliminated from perfume formulations due to the above-described process conditions.

Therefore, there is also a need for fabric sheet manufacturing techniques that would allow for increased usage of high note perfumes, wherein the highly volatile perfumes are retained on the fabric sheet so as to reach the consumer.

SUMMARY

For simplicity, "perfume" will be used herein to describe a fabric treatment agent that can volatilize or degrade from heat in an undesirable manner. It is within the scope of the present disclosure, however, that other volatile agents or heat sensitive agents can be advantageously applied by the presently disclosed process.

The present disclosure relates to a process that minimizes the loss of perfume and other volatile agents during the fabrication of dryer sheets. It has been found that it is possible to de-couple the addition of volatile or heat sensitive agents from one or more of the manufacturing process steps, particularly those portions that run at a high speed and/or high temperature.

In one preferred embodiment, the a selected agent or agents are applied during high speed web movement after high temperature application of other ingredients. In a second preferred embodiment, the selected agent or agents can be applied just prior to folding and packaging.

It has been found, for example, that by adding the perfume or other volatile agents closer to the step of packaging, i.e. after application of other ingredients in coating pan 15, there is less loss of ingredients to the atmosphere during the dryer sheet process. In the case of perfumes, this new process has less affect on the perfume profile and, therefore, a wider variety of perfumes can be used. In addition, because ingredients are no longer lost or lost to a lesser extent, less of the ingredient is needed when practicing the present disclosure, resulting in raw material cost savings.

DETAILED DESCRIPTION

Figure 3:
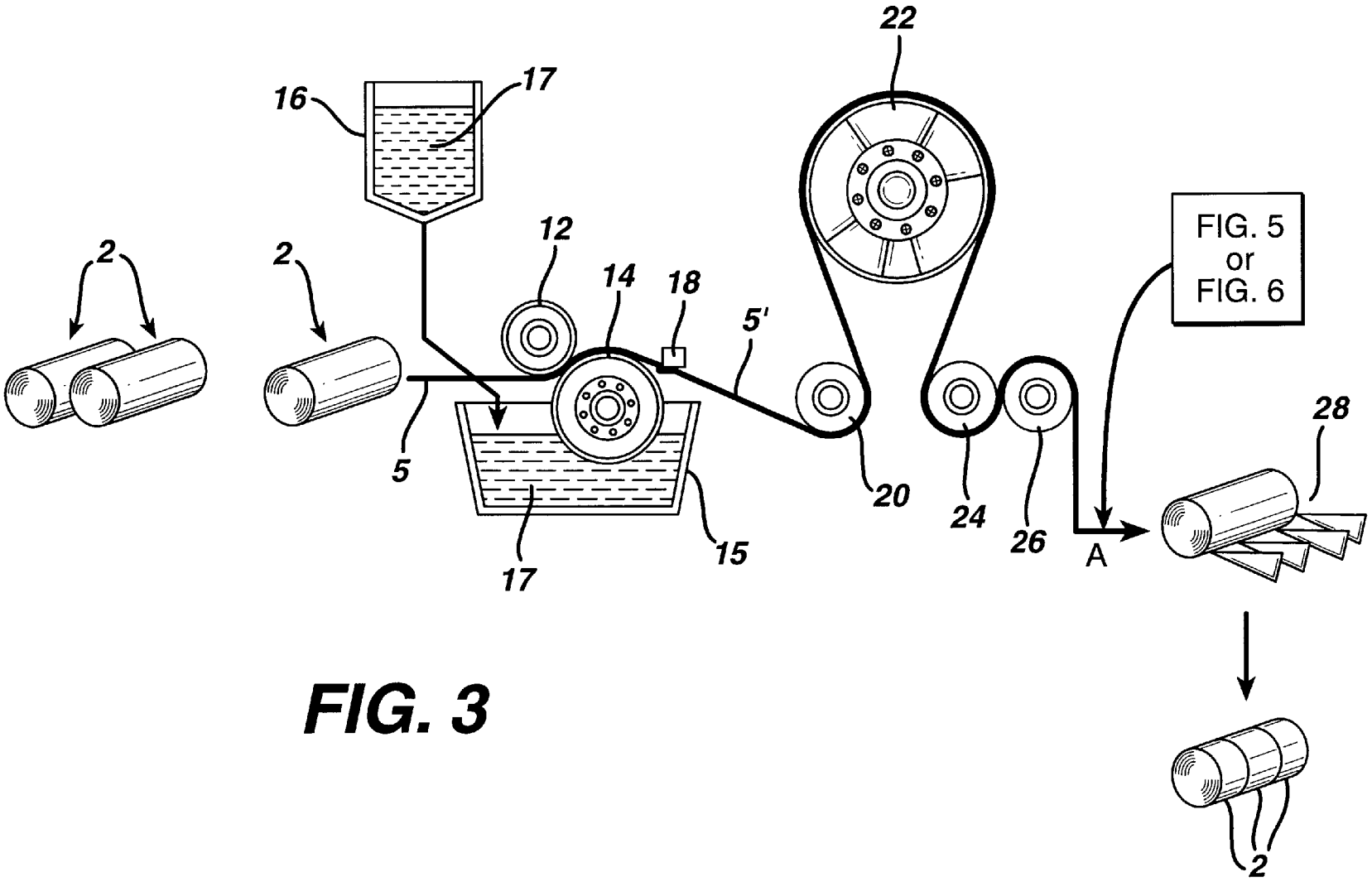
FIG. 3 illustrates a fabric sheet coating process that generally shows a preferred location of applying fabric treatment agents, subsequent to the main coating operation.
Figure 4:
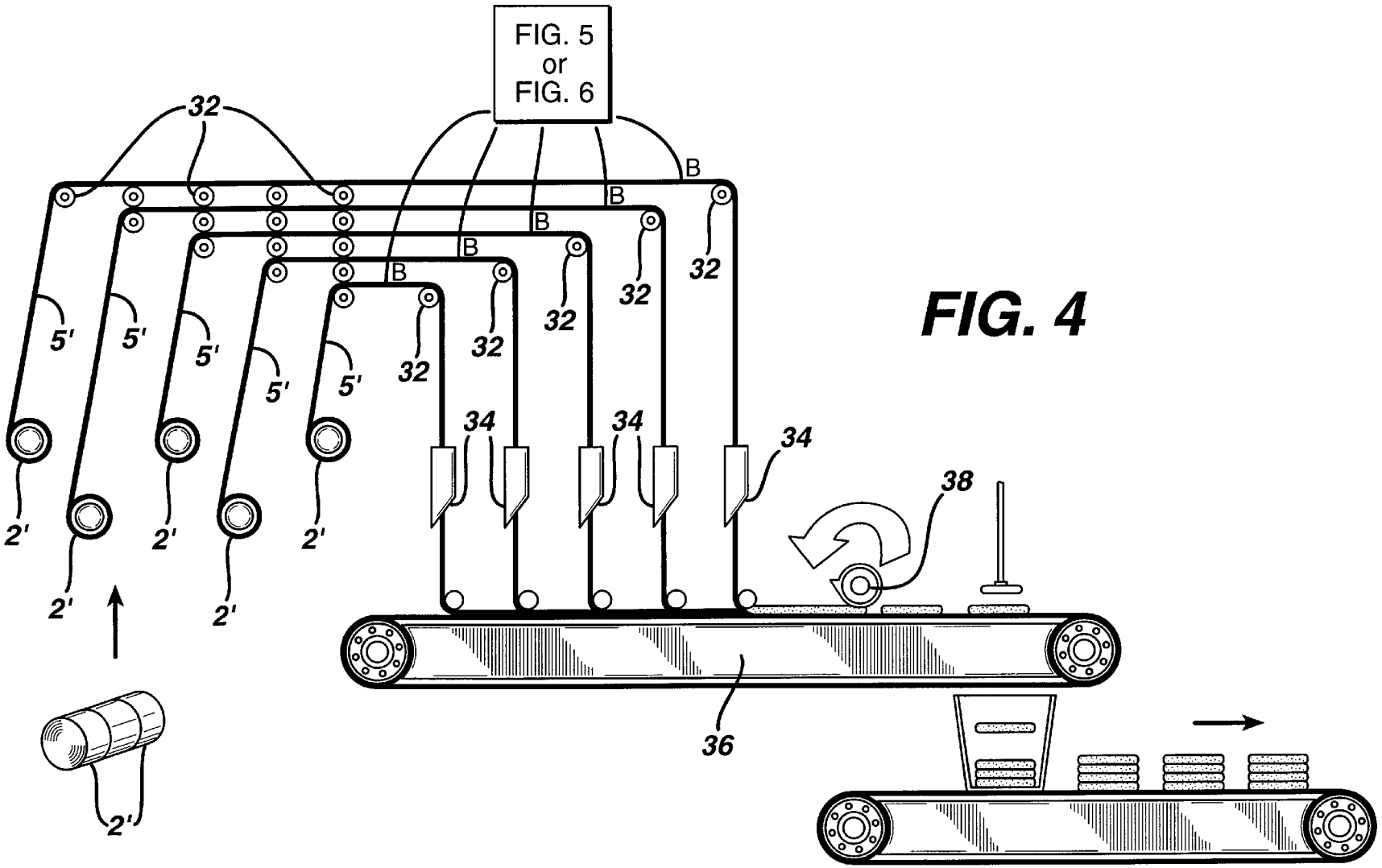
FIG. 4 illustrates a fabric sheet cutting and folding process that generally shows preferred locations of applying fabric treatment agents, subsequent to the main coating operation.

With reference to FIGS. 3 and 4, processes in accordance with the present disclosure are shown. FIG. 3 shows preferred fabric treatment agent application zone A, wherein ingredients can be added to web 5' subsequent to the coating of ingredients 17. Zone A is located after cooling drums 24 and 26 before cutting station 28. By applying perfumes and/or other fabric treatment agents at or near zone A, the high temperatures associated with the upstream coating operation are avoided. In addition, because web 5' is rolled-up at trimming station 28 shortly after application zone A, the fabric treatment ingredients become trapped as web 5' winds about itself.

FIG. 4 shows an alternate, preferred application zones B. In this embodiment, the fabric treatment agents are applied in prior to final folding and cutting of the substrate. Several zones are shown because the preferred process performs several cutting and folding operations simultaneously. An advantage of waiting to apply certain fabric treatment agents just prior to cutting and folding is that roles 2' can be generic across several brands. More specifically, for example, if the only difference between two or more brands of product is the type or quantity of perfume, rolled stock 2' can be used for each brand as needed.

Figure 5:
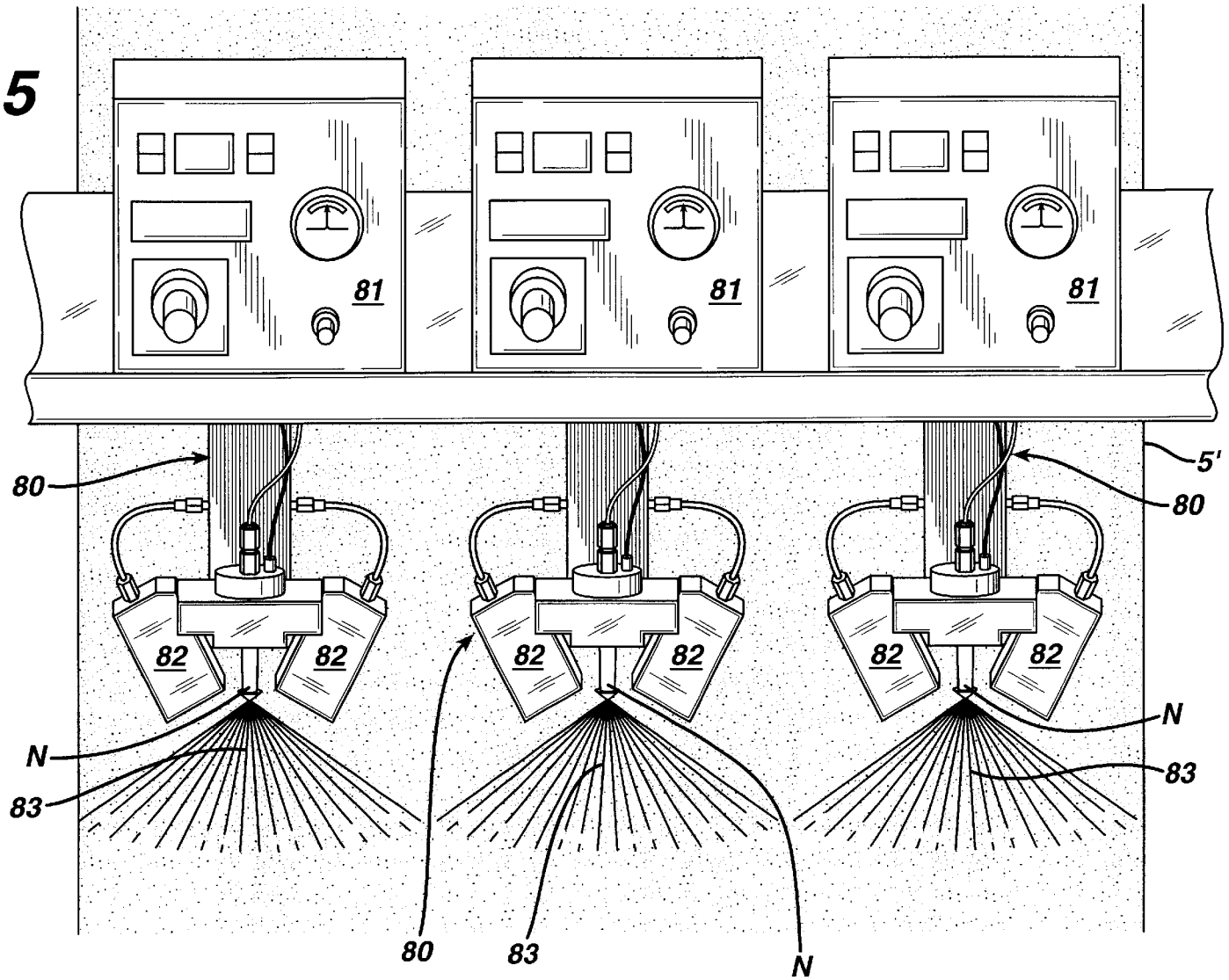
FIG. 5, illustrates a preferred method and apparatus for applying fabric treatment agents to a substrate material that can be used in the processes shown in FIGS. 3 and 4.

Turning to FIG. 5, a preferred apparatus for applying fabric treatment agents to web 5' is shown. Spray assemblies 80 have controllers 81 and air flow modules 82 for controlling the flow and spray pattern of liquid spray 83 emitted from nozzles N. Spray assemblies 80 can be pressure spray assemblies or, more preferably, ultrasonic sprayers as shown. Preferred ultrasonic spray assemblies are available from Sono-Tek Corporation, Milton, N.Y. The Sono-Tek sprayers use ultrasonic power to atomize liquids. The flow of liquid from nozzles N and the flow of air from modules 82 are regulated by controllers 81. Controllers 81 can be programmed to apply more or less liquid agent and can be coupled to web speed information so as to apply predetermined, uniform quantities of fabric treatment agent. While three spray assemblies or shown, one or more can be used, depending on the width of web 5' and on the width of the spray. Spray assemblies can be used in zones A or B of FIGS. 3 and 4, respectively.

Figures 6, 7:
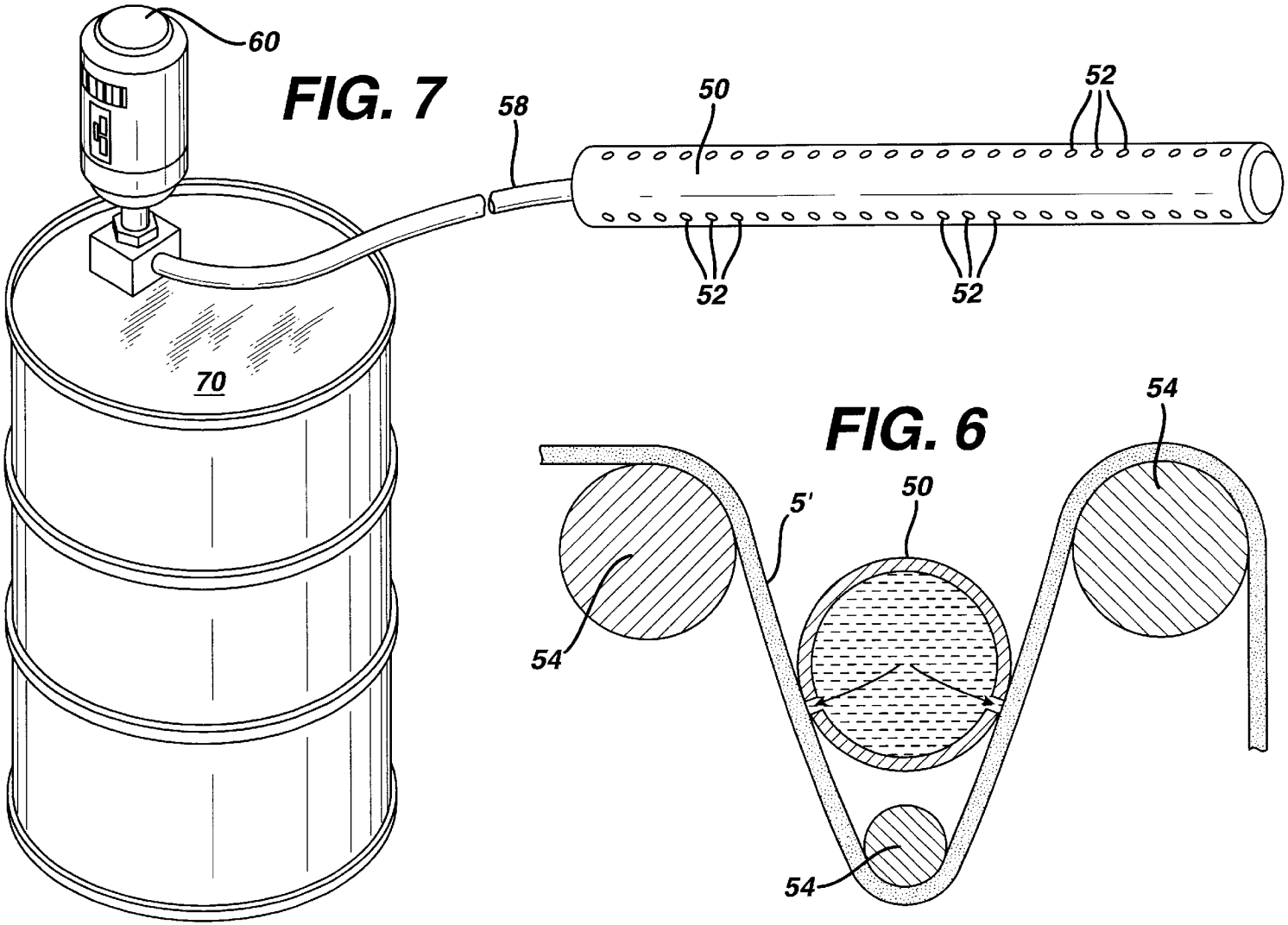
FIG. 6 illustrates an alternate, preferred method and apparatus for applying fabric treatment agents to a substrate material that can be used in the processes shown in FIGS. 3 and 4.
FIG. 7 illustrates a preferred method of transferring liquid agents to the apparatus of FIG. 6.

With reference to FIGS. 6 and 7, an alternate preferred apparatus for applying fabric treatment agents web 5' is shown. In FIG. 6, the perfume applicator generally includes tubular member 50 having a plurality of micro holes 52. Web 5' is directed past the applicator by one or more guide rolls 54. The number and configuration of guide rolls 54 is not critical and could even be eliminated.

Figure 8:
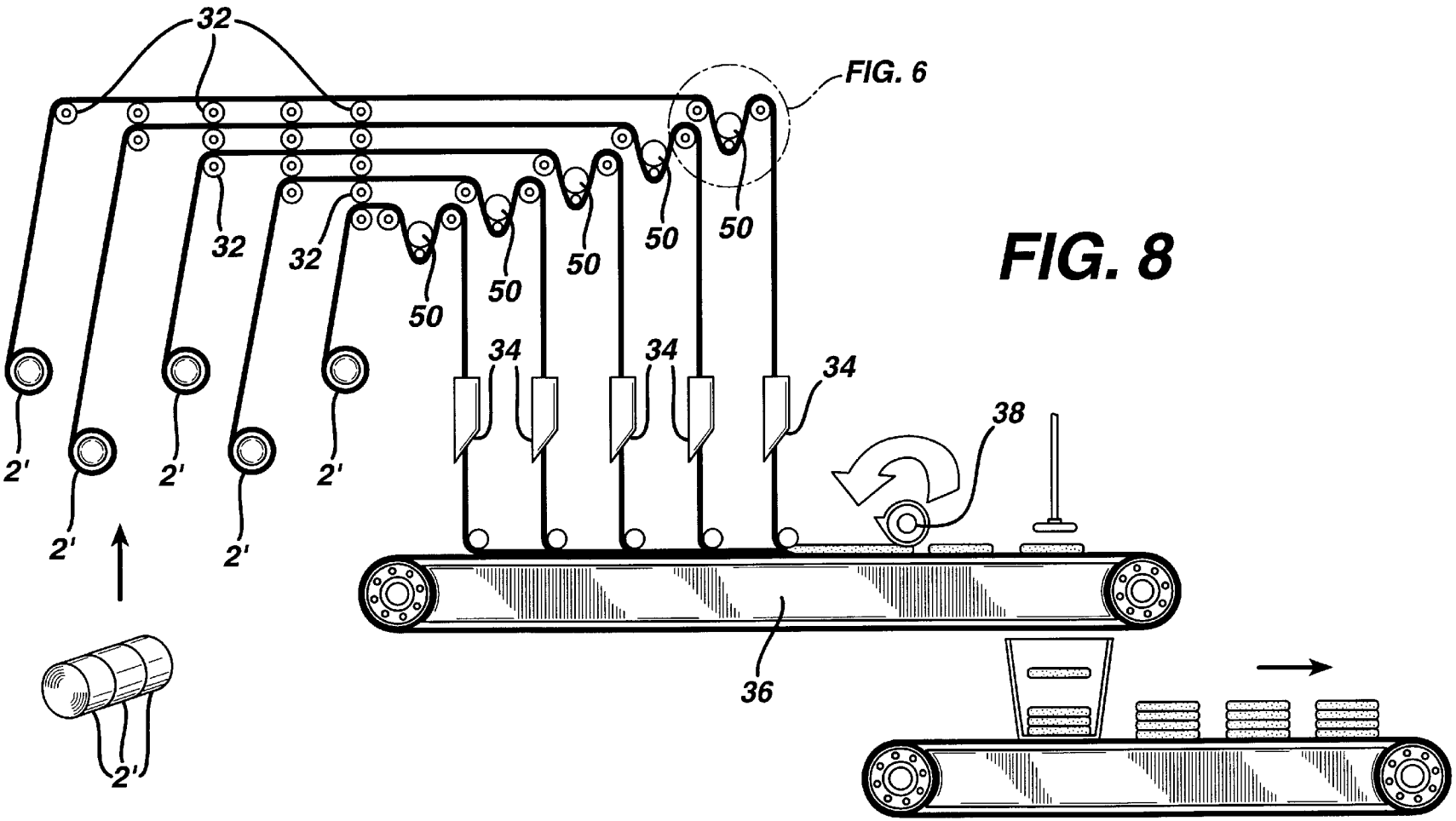
FIG. 8 illustrates a fabric sheet cutting and folding process that shows the apparatus of FIG. 6 at preferred locations.

Liquid fabric treatment agent is preferable pumped into applicator 50 by means of a metering pump 60 associated with tank 70. As shown, the liquid passes through tube 58, into one end of applicators 50. Most preferably, the liquid is pumped into applicators 50 through a manifold (not shown) that directs the liquid into each end of the applicators 50. Such a system can provide a more uniform pressure profile within applicator 50. Applicators 50 are preferably fabricated from a low friction material that can apply the fabric treatment agents to the web as it contacts tubular member/applicator 50 and passes over the micro holes. While two rows of micro holes are shown, various combinations of holes, slits or other orifice that allow the liquid to exit the applicator can be used. Applicators 50 can be used in zones A or B of FIGS. 3 and 4, respectively. FIG. 8 shows several applicators similar to FIG. 6 in use prior to the steps of cutting and folding.

In a preferred process where one or more of the fabric treatment applicators are used to apply perfume, at least between about 50% to about 75% by weight of the total perfume in the final product is added after the high temperature coating operation. In a most preferred process about 95% to about 100% by weight of the total perfume in the final product is added after the high temperature coating operation.

By applying certain fabric treatment agents at either or both zone A and zone B, the need for changing and cleaning ingredients 17 in coat pan 15 can be eliminated, allowing for manufacturing efficiencies.

Figure 1:
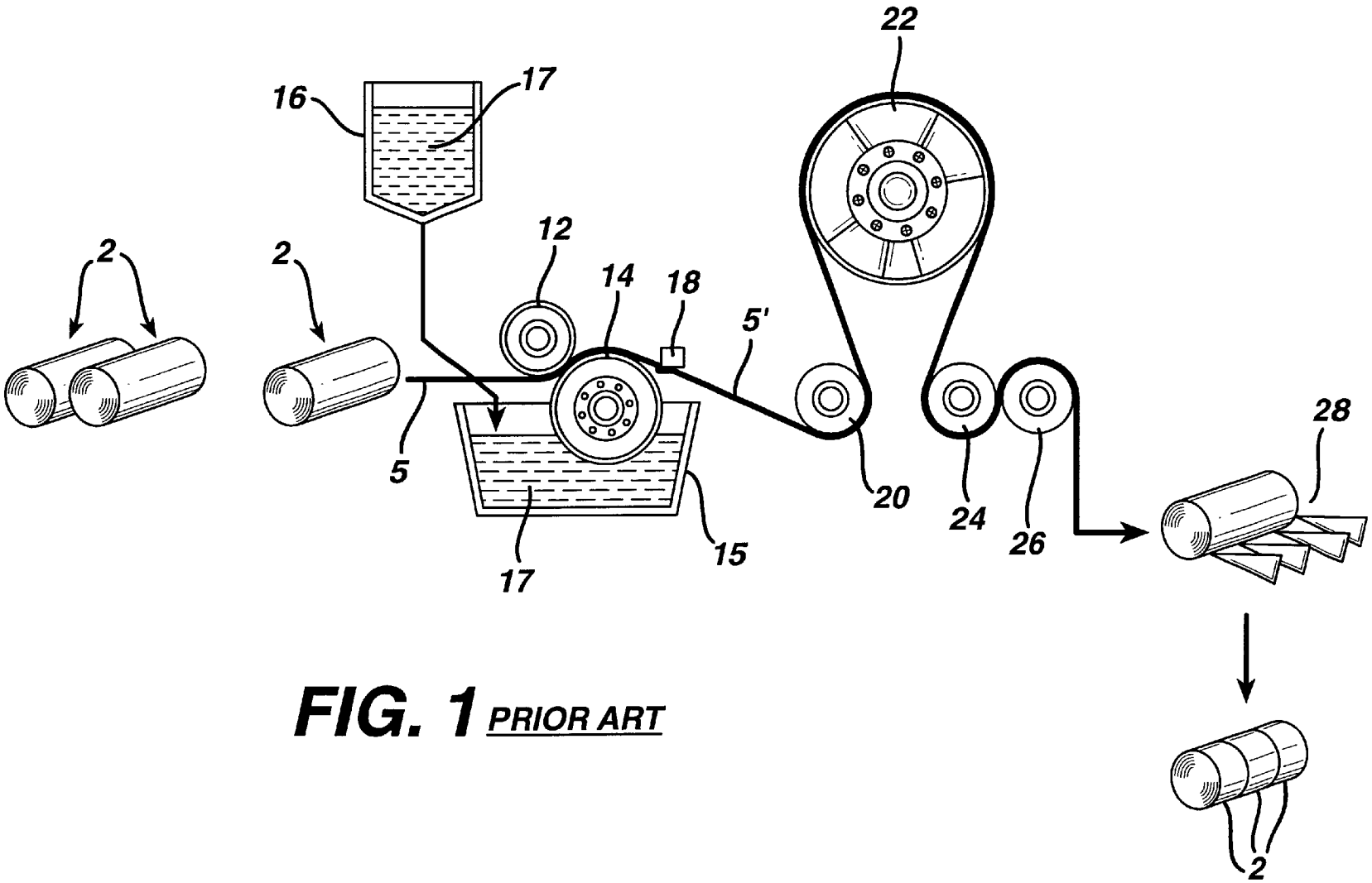
FIG. 1 PRIOR ART
FIG. 1 illustrates a fabric sheet coating process that is known in the art.

In practice it was unexpectedly found that the post-added perfume could absorb into the dryer sheet material that was processed as shown in FIG. 1. By absorbing, the sheet remained "non-tacky", and processing, such as cutting and packaging, were not hindered. See example 2, below.

EXAMPLE 1

Figure 2:
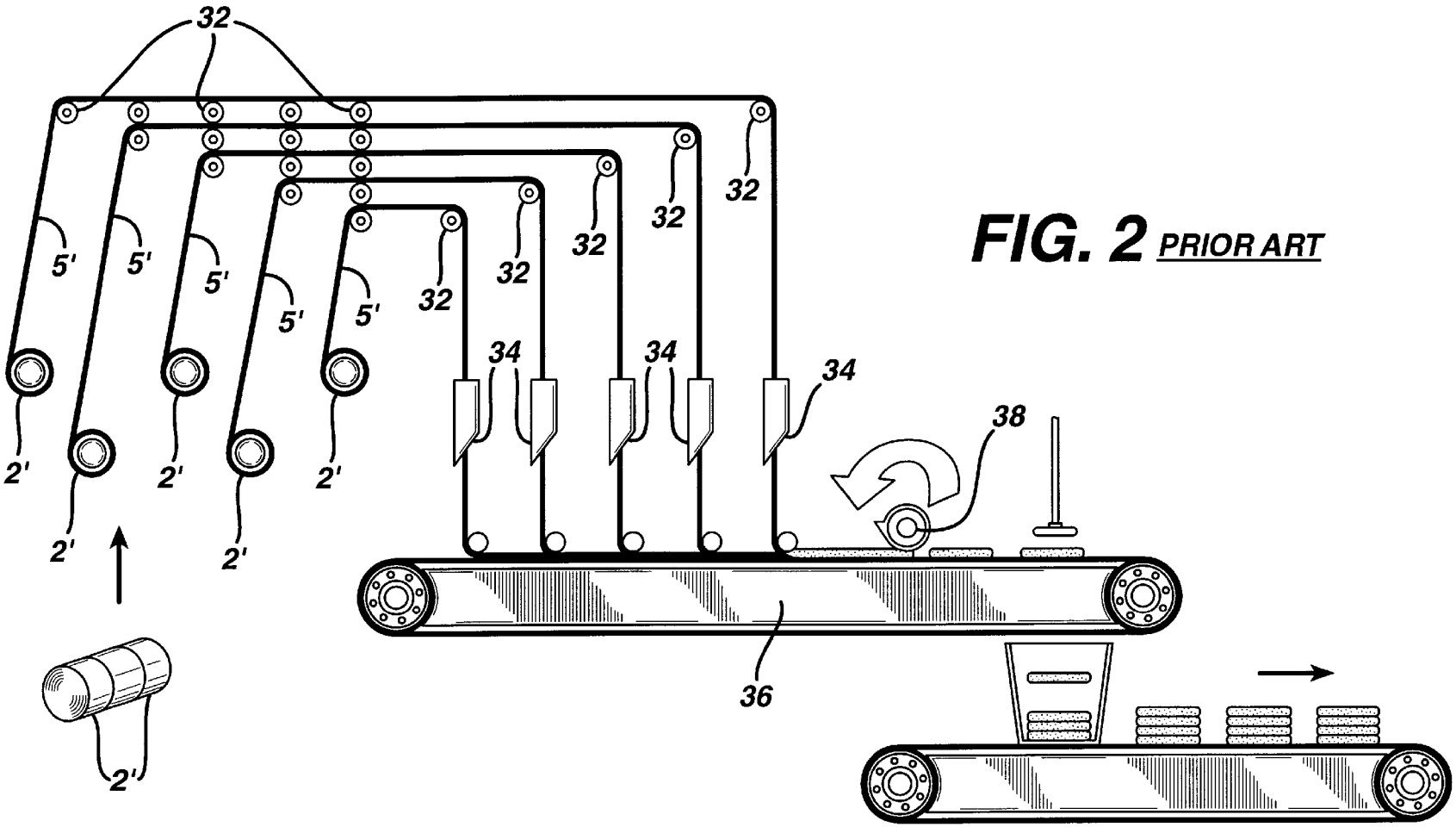
FIG. 2 PRIOR ART
FIG. 2 illustrates a fabric sheet cutting and folding process that is known in the art.

An 11 inch by 6.75 inch polyester substrate was first coated with 1.392 grams of anti-static/softening agent on a bench-top coater. Subsequently, 0.058 grams of perfume (4% by weight, excluding the weight of the substrate) was sprayed onto the coated sheet. This sheet and a typical production sheet were analysed by a HeadSpace GC. The production sheet was produced using the process shown in FIGS. 1 and 2, i.e., without de-coupling the perfume from the coating step. The perfume level in ingredients 17 dosed into coat pan 15 was also initially 4% by weight. The analysis data is shown in the following table.

TABLE 1

| Sample | Perfume added, g | Perfume remaining, g | Perfume Loss, % |
|---|---|---|---|
| Lab Sample | 0.058 | 0.055 | 5.0 |
| Production sheet | 0.058 | 0.033 | 42.5 |

The data indicates that the new process has improved the perfume retention. Therefore, for example, if the final product sold to the consumer only needs 0.033 g of perfume to deliver the expected perfume benefit, the methods disclosed herein allow for the addition of only 0.0347 g of perfume per sheet to deliver the same/expected amount—more than 40% reduction in perfume use.

EXAMPLE 2

An 11-inch wide dryer sheet roll was coated with anti-static/softening agent and perfume via the production process of FIG. 1. The role was mounted on a pilot scale coater. An applicator device as shown in FIG. 6 was set to contact the web of dryer sheet between unwind and rewind rolls. The roll was unwound and rewound at the speed of 10 ft/min while a pump was pumping perfume with the flow rate of 1.03 g/min onto the coated web. The addition of perfume is equal to extra 4% of perfume added to the sheet. The sheets with the extra 4% perfume made by this method showed a minimum increase of tackiness. Thus, the process was demonstrated.

What is claimed is:

1. A method for making a dryer sheet comprising the steps of:

(a) applying fabric treatment ingredients to a substrate suitable for use in a clothes dryer to produce a treated substrate; and (b) applying perfume to the treated substrate, the perfume of step (b) not being formulated within a fabric-treating composition wherein step (a) is carried out at about 140° F. to about 190° F. and step (b) is carried out below about 100° F., and the perfume is dispensed on to the treated substrate with a tubular member having a plurality of orifices or by spraying the perfume on to the treated substrate.

2. The method for making a dryer sheet according to claim 1 wherein from about 50% to about 75% of total perfume applied to the substrate is applied during step (b).

3. The method for making a dryer sheet according to claim 1 wherein from about 95% to about 100% of total perfume applied to the substrate is applied during step (b).

4. The method for making a dryer sheet according to claim 1 wherein the substrate is cut and boxed.

5. The method for making a dryer sheet according to claim 1 wherein the perfume is liquid perfume.

6. The method for making a dryer sheet according to claim 1 wherein the perfume of step (b) is disposed by spraying the perfume.

7. The method for making a dryer sheet according to claim 6 wherein the perfume is sprayed from nozzles.

* * * * *